US009909339B2

(12) United States Patent
Baver

(10) Patent No.: US 9,909,339 B2
(45) Date of Patent: Mar. 6, 2018

(54) HIGH-SECURITY CYLINDER LOCK BASED ON BRIDGE TUMBLERS

(71) Applicant: Derek Baver, Boulder, CO (US)

(72) Inventor: Derek Baver, Boulder, CO (US)

( * ) Notice: Subject to any disclaimer, the term of this patent is extended or adjusted under 35 U.S.C. 154(b) by 0 days.

(21) Appl. No.: 15/190,530

(22) Filed: Jun. 23, 2016

(65) Prior Publication Data

US 2016/0376815 A1 Dec. 29, 2016

Related U.S. Application Data

(60) Provisional application No. 62/184,373, filed on Jun. 25, 2015.

(51) Int. Cl.

| | |
|---|---|
| ***E05B 29/02*** | (2006.01) |
| ***E05B 29/00*** | (2006.01) |
| ***E05B 31/00*** | (2006.01) |
| ***E05B 27/00*** | (2006.01) |

(52) U.S. Cl.

CPC ..... *E05B 29/002* (2013.01); *E05B 27/0078* (2013.01); *E05B 27/0082* (2013.01); *E05B 29/0033* (2013.01); *E05B 29/0053* (2013.01); *E05B 29/0066* (2013.01); *E05B 31/00* (2013.01)

(58) Field of Classification Search

CPC .. E05B 27/00; E05B 27/0032; E05B 27/0078; E05B 27/0082; E05B 29/00; E05B 29/0013; E05B 29/002; E05B 29/0033; E05B 29/0053; E05B 29/0066; E05B 31/00

See application file for complete search history.

(56) References Cited

U.S. PATENT DOCUMENTS

| | | | | |
|---|---|---|---|---|
| 3,455,130 | A | 7/1969 | Basseches | |
| 3,722,240 | A | 3/1973 | Spain et al. | |
| 4,478,061 | A * | 10/1984 | Preddey | E05B 27/00 70/358 |
| 4,635,455 | A * | 1/1987 | Oliver | E05B 27/0039 70/378 |
| 5,018,376 | A | 5/1991 | Lee | |
| 5,209,087 | A | 5/1993 | Cox | |
| 5,570,601 | A * | 11/1996 | Field | E05B 27/0039 70/409 |
| 6,477,875 | B2 | 11/2002 | Field et al. | |
| 6,481,255 | B2 | 11/2002 | Theriault et al. | |

(Continued)

FOREIGN PATENT DOCUMENTS

GB 1223142 A 2/1971

OTHER PUBLICATIONS

PCT International Search Report and Written Opinion dated Sep. 13, 2016, International Application No. PCT/US2016/038943, International filing date Jun. 23, 2016, Applicant: Baver, Derek.

*Primary Examiner* — Christopher J Boswell

(74) *Attorney, Agent, or Firm* — Burns & Levinson, LLP; Jerry Cohen

(57) ABSTRACT

A bridge tumbler lock has tumblers that both slide and pivot, with their motion controlled by pairs of key interfaces. A sidebar is released to permit lock opening movement when all tumblers are in their correct positions. This results in a lock that is resistant to release of information due to partially correct key combinations occurring in the course of a lock picking attempt and thus enables enhanced security in an economical, effective lock construction.

13 Claims, 8 Drawing Sheets

(56) References Cited

U.S. PATENT DOCUMENTS

| | | | | |
|---|---|---|---|---|
| 7,487,653 | B2 * | 2/2009 | Widen | E05B 27/0039 70/409 |
| 7,685,854 | B2 | 3/2010 | Xu et al. | |
| 7,797,973 | B2 | 9/2010 | Field et al. | |
| 8,061,168 | B2 * | 11/2011 | Widen | E05B 19/0023 70/409 |
| 8,448,485 | B1 | 5/2013 | Widen | |
| 8,635,022 | B2 | 1/2014 | Nguyen et al. | |
| 8,720,241 | B1 * | 5/2014 | Widen | E05B 27/0039 70/409 |
| 9,464,459 | B2 * | 10/2016 | Walls | E05B 27/0017 |
| 2014/0223977 | A1 * | 8/2014 | Wu | E05B 27/0071 70/493 |

* cited by examiner

HIGH-SECURITY CYLINDER LOCK BASED ON BRIDGE TUMBLERS

FIELD AND BACKGROUND OF THE INVENTION

The present invention relates to keyed locks, and more particularly to a rotatable cylinder lock employing a sidebar as its primary mechanism for restricting cylinder rotation. The application claims priority of provisional application Ser. No. 62/184,373 filed 25 Jun. 2015.

Sidebars are commonly used in cylinder locks to restrict rotation of the cylinder. These are primarily used in locks that employ tumblers that both slide and rotate, such as Medeco-type locks exemplified by its U.S. Pat. No. 7,779,973 issued 21 Sep. 2010, in typical locks of this type, the sidebar introduces additional degrees of freedom that must be aligned in order for the cylinder to rotate as compared to a conventional sliding tumbler lock. In these cases, rotating the tumblers allows lugs on the sidebar to enter a groove or hole on the tumbler, whereas sliding the tumbler aligns the edge of the tumbler with the shear line. However, there exist some types of lock that use a sidebar as the sole mechanism to limit cylinder rotation. In one such lock of this type, (exemplified by U.S. Pat. No. 3,722,240 issued 27 Mar. 1973) the lugs on the sidebar are only aligned with the holes on tumblers if they are correctly positioned in both elevation and rotation.

Locks of the latter type offer a high degree of security against lock picking techniques. This is not only because they introduce extra degrees of freedom resulting in a larger number of possible key combinations, Rather, it is, to a large extent, because they require each tumbler to be simultaneously aligned along two different axes, or degrees of freedom, before it will exhibit any change in behavior that the lock picker can use to gain useful knowledge of the correct key combination. This contrasts with sliding tumblers, which have only one degree of freedom, therefore guaranteeing that, if they are traversed across their full range of motion, the correct tumbler position will eventually be reached; the question is merely whether the lock picker is skillful enough to detect and interpret the resulting change in behavior. In a tumbler with two degrees of freedom that must be simultaneously aligned, there is no guarantee that any given search pattern will bring the tumbler close enough to correct alignment to produce a useful change in behavior, unless the precision of the lock is also known. Even then, the resulting search pattern will be extremely time consuming to execute State of the art generally is indicated in U.S. Pat. No. 5,018,376 (Lee), U.S. Pat. No. 6,481,255 (Theriault et al), U.S. Pat. No. 7,685,854 (Xu et al); U.S. Pat. No. 7,797,973 (Field et al, Le., the Medeco patent mentioned above); U.S. Pat. No. 8,448,485 (Widen); and U.S. Pat. No. 8,635,022 (Nguyen et al).

Some problems with locks of this type are related to cost and convenience. Using a sidebar increases the part count and especially feature count of the lock, resulting in a lock that is more expensive to manufacture. Also, the keys required by this type of lock are more complicated, making them more difficult to manufacture or to duplicate.

Another issue with locks of this type is that the advantage of having two degrees of freedom per tumbler is reduced if the sidebar pins interface with a hole on a curved surface. This is because, once the center of the sidebar lug is partially over the hole, the pin will be able to depress slightly, since the lug is supported at a point that is not along the shortest path between the lug and the center of the tumbler. This provides information that allows a lock picker to use a relatively loose search pattern to find approximately where the correct tumbler position is, then use a finer search pattern to achieve exact alignment.

Yet another issue is the size of the lugs on the sidebar. This is a result of a design trade-off created by the aforementioned problem of having a curved tumbler surface. If the lugs are too large, the range of tumbler positions in which the tumbler lug will be able to partially depress is large. On the other hand, if the tugs are too small, the lock will be vulnerable to forcing. Such a trade-off prevents the design of a lock that is strong against both lock picking and forcing. For example, the drawings in U.S. Pat. No. 3,722,240 depict tumbler lugs of relatively small size.

Finally, even if the radius of the sidebar lugs is increased, the cross-sectional area of the sidebar lugs is still small compared to the sidebar itself, thus the lock will still not achieve optimal forcing resistance.

SUMMARY OF THE INVENTION

In the present invention a lock construction is provided in which a sidebar interfaces with a reduced number of tumblers, with effective, preferably flat, tumbler surfaces for this interface, and, preferably, it is constructed and arranged to be able to use a similar type of key to that used in locks with sliding tumblers.

It is an object of this invention to create a lock, consistent with the said object, that is mechanically simple, uses a standard-type key, and yet is extremely difficult to pick by conventional techniques. This is accomplished with a type of tumbler hereafter referred to as a bridge tumbler. Each bridge tumbler comprises a plate, preferably flat at one surface, that is capable of sliding along an axis parallel to the plane of its surface, as well as rotating on an axis perpendicular to this plane. A pair of pins allows each bridge tumbler to interface with an inserted key at two different positions, so that the combination of these positions controls both of its degrees of freedom. On the side facing the sidebar there are a number of holes into which lugs on a sidebar are able to enter, only one of which is deep enough to free a sidebar and permit the lock to rotate. Linear sliding as used herein includes straight line and other lines (e.g. curved, zig/zag, stepped, etc.)

The cylinder contains one or more chambers in each of which a bridge tumbler resides, with one side having a groove to limit sliding motion of the bridge tumbler to a single axis. Two deeper grooves connect each chamber to the keyway, allowing the bridge tumblers' lugs access to the key to be moved. A sliding cover encloses these chambers once the tumblers are inserted. A hole connects each chamber to a recess on the side of the cylinder which houses the sidebar. Indentations may be provided in this recess to house springs to maintain contact between the sidebar and lock housing, and additional springs may press against the bridge tumbler pins in order to maintain contact between the tumbler and the key.

Where the sidebar-facing surface of the bridge tumbler is flat, there is no significant change in pressure or position between the sidebar and the tumbler when a sidebar lug is partially aligned with a hole in the tumbler. Moreover, because friction is proportional to both pressure and area, there is no significant change in friction for a given force on the sidebar lug as the interface area decreases due to partial alignment. This requires a lock picker to use a fine search pattern to find the correct position for each tumbler.

Decoy holes are provided in one or more of the tumblers. The decoy holes further delay the lock-picker because it is not possible to distinguish a decoy hole from a correct hole until all tumblers have holes aligned with sidebar lugs. Only then can the sidebar traverse enough for the lugs to reach the bottom of the decoy holes, revealing their true nature. By presenting the lock picker with a combination of two-dimensional searching for correct tumbler alignment and decoy alignments that cannot be easily distinguished from correct alignments, the time required to pick the lock can be increased by multiple orders of magnitude despite having a smaller overall number of tumblers compared to prior tumbler locking systems.

Some of the aforementioned features bear resemblance to U.S. Pat. No. 8,448,485 (Widen). However, there are several important differences: First, the lock of the present invention here uses a conventional key interface on its upper surface. Widen uses a key interface on its side surface in the preferred embodiment, and while he considers an interface on its upper surface, this is not a conventional key. Second, a preferred embodiment of the lock of the presentinvention provides lugs on the sidebar, whereas Widen's lock provides lugs on the tumblers. While Widen considers the possibility of using lugs on the sidebar, the embodiments he proposes do not work as there exist tumbler positions in which the sidebar lugs are able to bypass the tumblers entirely. This lock embodies a method for making this work. Placing the lugs on the sidebar is important because this stores information in the tumblers, which means that parts are less unique and thus more combinations can be used in a mass-produced lock. Third, the use of a center lug on the tumblers allows for more precise control of the axis of sliding than in Widen's case, as well as permitting a greater variety of tumbler shapes. A shield shape preferably used in the lock of the present invention is not possible using Widen's design. Finally, the large number of lock combinations per tumbler (mentioned as in Widen but not in its preferred embodiment, and possibly impractical due to limitations in the disclosed design) is essential for achieving high security.

In order to increase resistance to forcing, the lock housing of the lock of the present invention contains a cavity covered by a flexible plate, which faces the sidebar when the lock is closed. If excessive torque is applied to the lock, this plate will deform, changing the angle at which force is applied to the sidebar and thus relieving pressure from the sidebar lugs.

For a better understanding of the present teachings, together with other and further objects thereof, reference is made to the accompanying drawings and detailed description of embodiments thereof and its scope is as stated in the claims below.

DETAILED DESCRIPTION OF PREFERRED EMBODIMENTS

The following described embodiments of the invention comprise a movable cylinder lock (cover all or as a movable cylindrical comprising a lock) and key combination in which the rotation of the cylinder is restricted by a sidebar, which is into a recess in the lock housing. The sidebar has a number of projecting lugs, which fit into recesses in a corresponding number of bridge tumblers.

Figure 1:
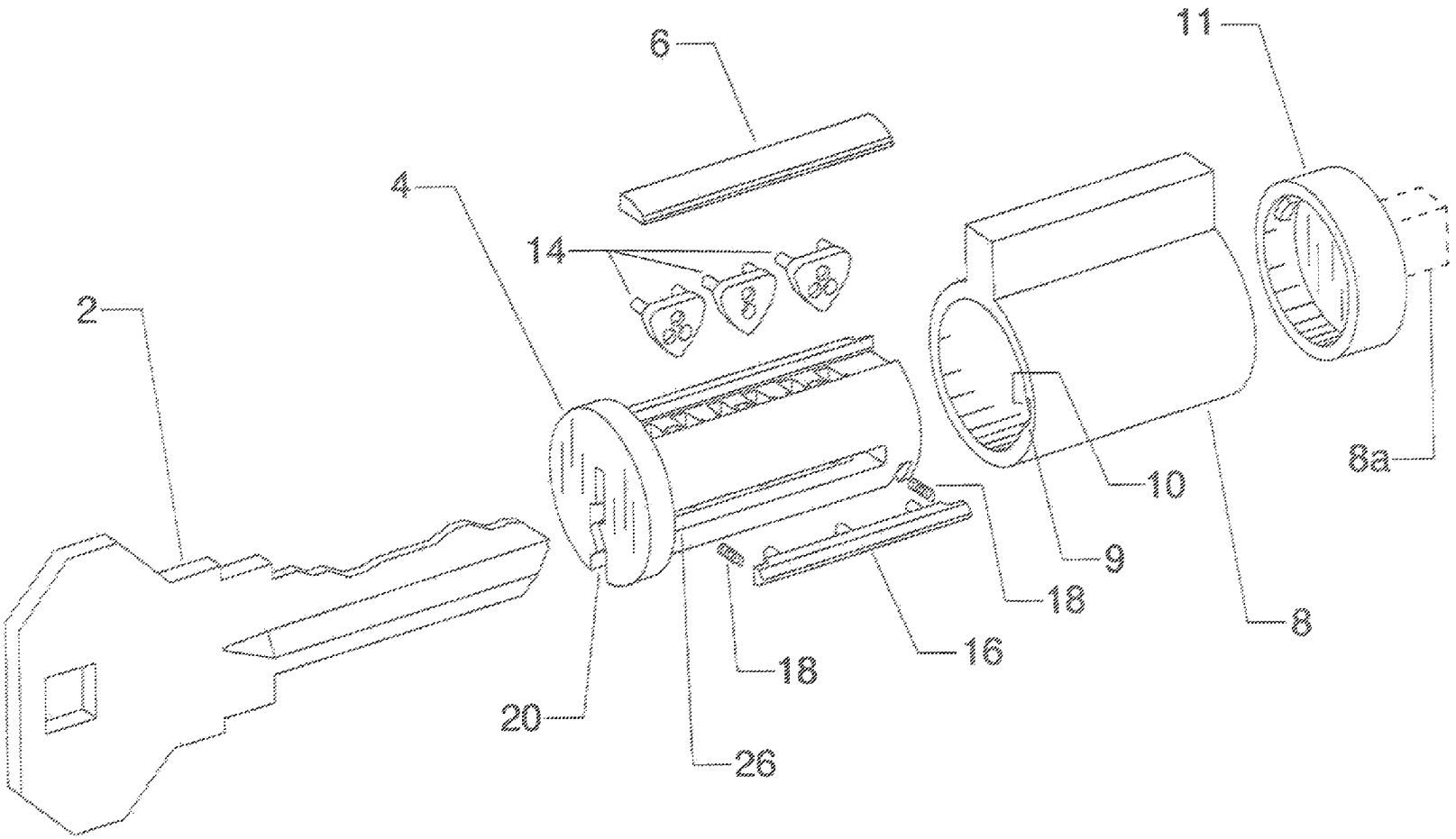
FIG. 1 is an exploded view of the lock mechanism, showing the key, cylinder, housing, tumblers, and sidebar according to an embodiment of the invention shown together with a conventional key and a locking unlocking structure affixed to a portion (cap) of the locking mechanism.

Each bridge tumbler comprises a plate, preferably flat, with a number of pins on one side (face) of the plate, preferably three and a number of holes on the other. One of these three pins is shorter than the others and fits into a groove in the cylinder, resulting pivot point at which the tumbler can only slide in one direction. The other two pins protrude into a keyway, interfacing with the key, which can be a conventional key as indicated in FIG. 1. Each pair of key positions therefore controls the transverse and rotational motion of the tumbler. The average of the pair determines the transverse position of the tumbler while the difference determines the rotational position. One of the holes on the other side of the tumbler plate is deep enough to allow lugs on the sidebar to enter the tumbler, freeing the sidebar and allowing the lock to rotate. The others are not, and act as decoys to confuse a potential lock picker. As these holes are displaced a significant distance from the tumbler's pivot point, the rotational motion of the tumbler results in an axial displacement of these holes. Freeing the sidebar therefore requires the correct hole to be in the correct axial and transverse position, which can only occur if both of the pair of key positions are correct.

The recess in the lock housing is covered by a grooved plate, forming a vee-shape whereas the recess itself has a rectangular cross-section. When the plate is not deformed by excessive force, its shape forces the sidebar into the cylinder when the lock is rotated. If it is deformed by excessive force, the rectangular cross-section of the underlying recess results in a contact force on the sidebar that is in an azimuthal direction rather than a radial, and consequently fails to deliver sufficient force to push the sidebar into the cylinder. This protects the sidebar lugs from excessive force.

FIG. 1 shows an exploded view of a lock device embodiment. A key 2 is insertable into the cylinder 4 via its keyway 20. A slide 6 covers the top of the cylinder. The cylinder sits inside a housing 8 which has a notch 9 to engage a sidebar (described below). This notch is covered by a plate 10 (see, also FIG. 8 and discussion of it below). A cap 11 secures the cylinder inside the housing. A plurality of tumblers 12 with projecting lugs 14 rest atop the key due to gravity. A sidebar 16 sits in the sidebar well 26 where it is held against the housing by springs 18. The housing or cap has a detent 8*a* or like projection to activate locking/unlocking protected object (not shown) in response to cylinder rotation when the cylinder is properly rotated and engaged to rotate the housing therewith. Detent 8*a* is shown on the cap 11 but could be on the housing 8. FIG. 1 also shows the full lock mechanism operation. FIG. 1 also illustrates key 2 as a "conventional key" i.e., one with flat engagement upper or lower edge for functional engagement with tumblers of the lock. The lock mechanism can be used with other conventional or non-conventional keys.

Figure 2:
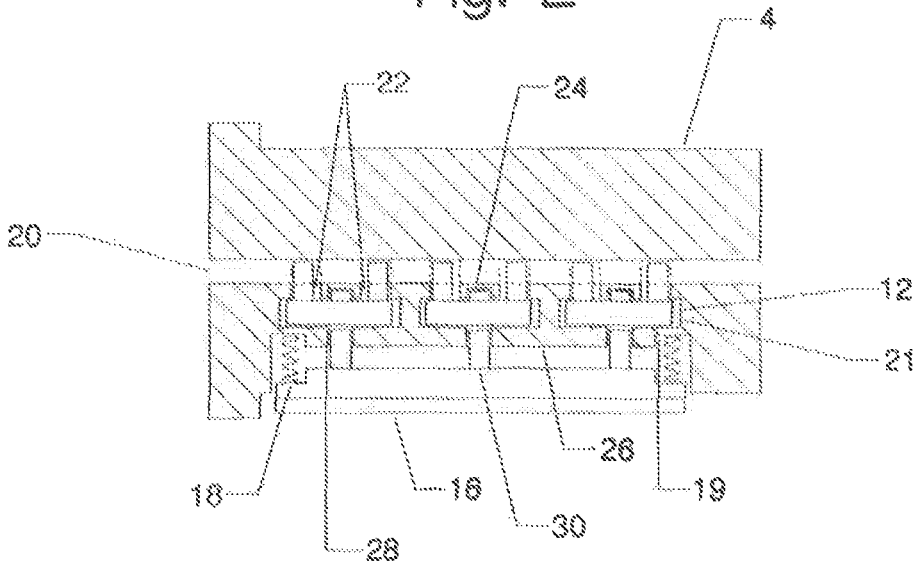
FIG. 2 is a top view, partially cross-sectioned, of the arrangement of tumblers inside the cylinder.

FIG. 2 is a top view, partially cross-sectioned, of the arrangement of tumblers inside the cylinder 4 with dashed lines indicating features not visible from the top, shows that the tumblers 12 sit in tumbler wells 21. These are connected by slots 22 to the keyway 20. A shallower slot 24 guides the tumbler, restricting its transverse rotational or pivoting motion to a single axis. The sidebar 16 sits in the sidebar well 26, supported by springs 18 that sit in their own wells 19, and a plurality of side bar lugs 30 extend through holes 28 to the tumbler wells, allowing the sidebar to engage the tumblers.

Figure 3:
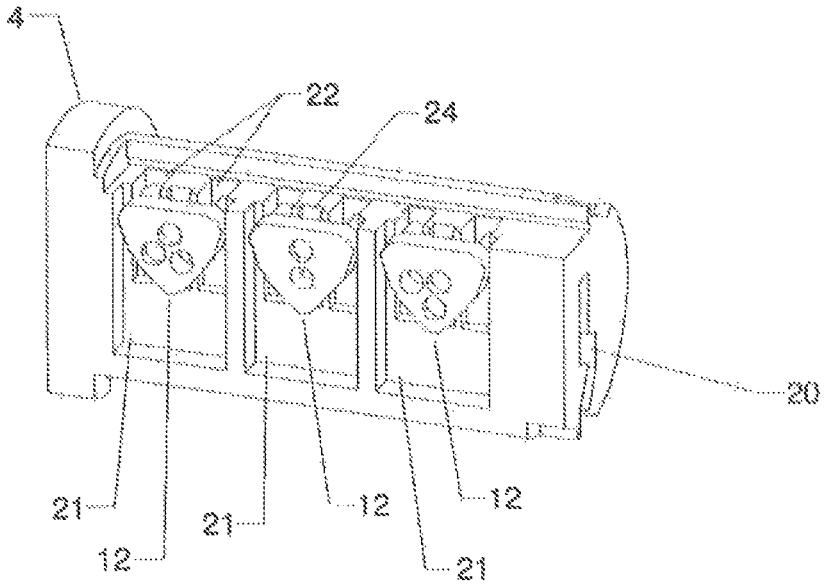
FIG. 3 is a cut-away side view of the arrangement of tumblers inside the cylinder.

FIG. 3 shows a cut-away side view of the cylinder 4, showing the positions of the tumblers 12 inside the tumbler wells 21. This also provides a view of the slots 22 connecting these to the keyway 20, and the guide slot 24.

Figure 4A:
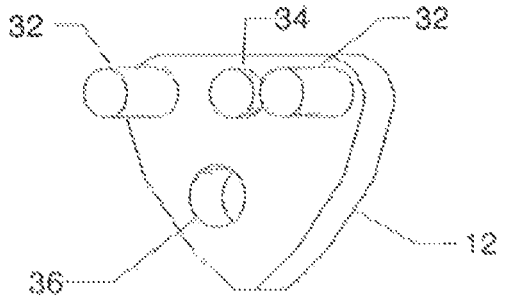
FIG. 4*a* is a close-up isometric view (expanded) of the key-facing side of a tumbler.

FIG. 4*a* shows a close-up of the key-facing side of the plate-form tumbler 12. On this side there are two long lugs 32 to interact with the key, (item 2 in FIG. 1) and one shorter lug 34 to guide the tumbler. Also shown is the deep hole 36 through the tumbler.

Figure 4B:
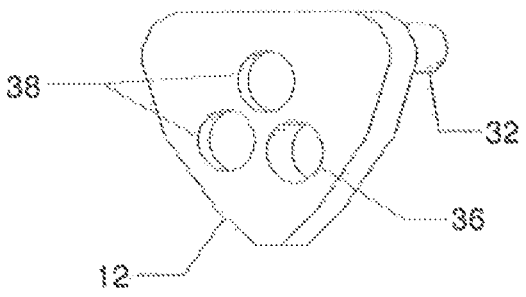
FIG. 4*b* is a close-up isometric view (expanded) of the sidebar-facing side of a tumbler.

FIG. 4*b* shows a close-up of the other side, i.e. the sidebar-facing side, of the tumbler 12. On this side are a number of holes. One of them 36 is deep enough to release the sidebar. The other holes 38 are not deep enough to completely release the sidebar, but imitate the behavior of the correct hole if the other tumblers are not correctly aligned. One of the long lugs 32 of the key facing side is also visible.

Figure 5:
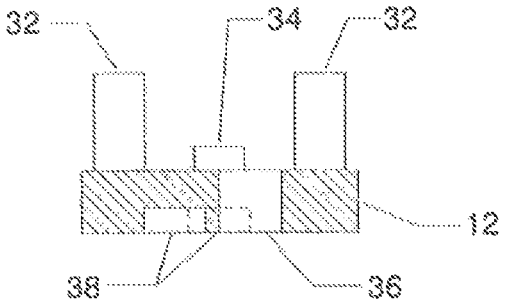
FIG. 5 is a partially cross-sectioned view close-up of the top (slide-facing) side of a tumbler.

FIG. 5 shows a top view cross-section of a tumbler 12. This shows the long lugs 32, the short lug 34, the deep hole 36, and one of the shallow holes 38. The other shallow hole is shown with dashed lines as it is behind (under) the other holes.

Figure 6A:
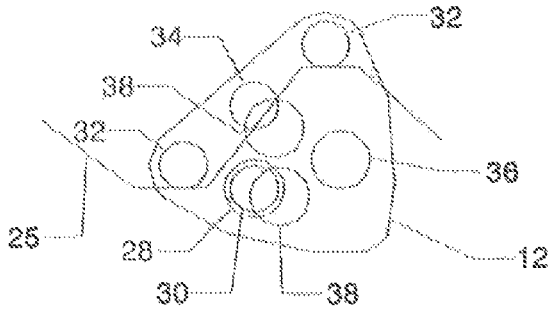
FIG. 6*a* shows the interaction between the key and a tumbler.

FIG. 6*a* shows the interaction between the key surface 25 and tumblers 12. This is accomplished by direct contact with the long tumbler lugs 32, causing a swiveling and sliding tumbler motion as it moves the deep hole 36 as well as the decoy holes 38 relative to the sidebar lug hole 28 and consequently the sidebar lug 30. The short lug 34 is also shown for clarity. It should be noted that that the placement of hole and legs as shown in FIG. 6*a* is exemplary and not limiting. For example, lugs and holes now shown in tumbler and sidebar placements could be reversed in whole or in part.

Figure 6B:
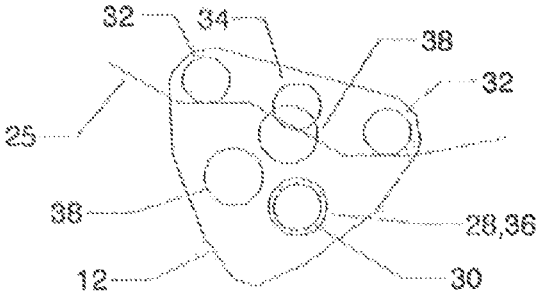
FIG. 6*b* shows the interaction between the key and a tumbler when in correct alignment.

FIG. 6*b* shows the same components as in FIG. 6*a* in correct alignment established by further movement of the key in the keyway. The deep hole 36 is now in the same position as the sidebar in 30.

Figure 7A:
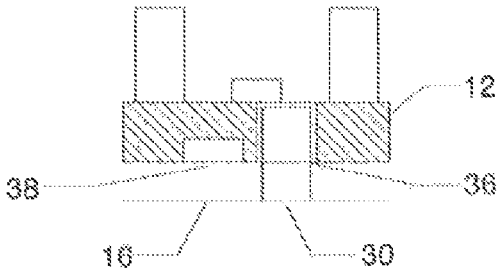
FIG. 7*a*, a partially sectioned top view, shows the interaction between a tumbler and the sidebar in correct alignment.

FIG. 7 is a partially sectioned top view, showing the interaction between the sidebar 16 and a tumbler 12 when the components are in incorrect alignment. Note that the sidebar lug 30 is able to penetrate into the deep tumbler hole 36. Decoy holes 38 are shown for comparison.

Figure 7B:
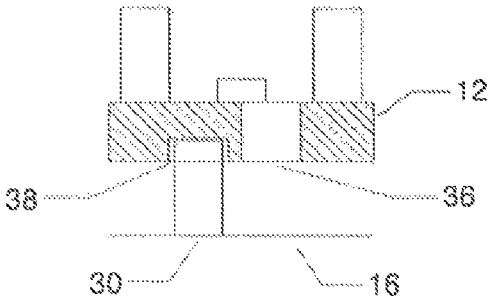
FIG. 7*b*, a partially sectioned top view, shows the interaction between a tumbler and the sidebar when in decoy alignment.

FIG. 7*b* shows the same components not in correct alignment for unlocking (i.e., in decoy alignment). Note that the sidebar lug 30 is only able to penetrate a short distance into the decoy hole 38.

Figure 8:
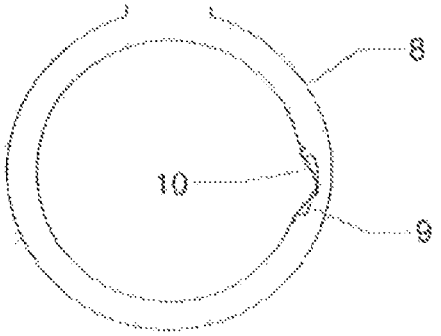
FIG. 8 shows the position of the sidebar facing plate within the lock housing.

FIG. 8 shows the position of the sidebar-facing vee-shaped plate 10 relative to the housing 8 and the sidebar-facing notch 9. As noted above, deformation of the plate by excessive force in an azimuthal direction changes the angle of force on the sidebar and thus prevents forcing of the side bar into the cylinder and prevents unlocking.

It should be noted that the large seat surface area of the tumblers and side bar provide resistance to forcing and also present a difficult "feel" detection prospect for a lock-picker compared to conventional rotatable cylinder locks.

Although the invention has been described with respect to various embodiments, it should be realized these teachings are also capable of a wide variety of further and other embodiments within the spirit and scope of the appended claims.

What is claimed is:

1. A cylinder lock comprising:

(a) a cylinder having an entry passage for key insertion, (b) one or more rotatable substantially flat surfaced tumblers with a shield form substantially planar body portion that, in response to insertion into said passage of a conventional key with upper or lower edge profiled surface, can respond to contact with said surface to slide linearly in a plane and can also rotate, to regulate alignments for enabling cylinder rotation for locking and unlocking, (c) each tumbler having its axis of rotation perpendicular to its direction of sliding and constructed and arranged to have its direction of sliding constrained by a central outward projection from the body portion of the tumbler that is rotatably journaled within a suitable groove in the cylinder.

2. A cylinder lock as in claim 1 wherein;

said direction of sliding constraint comprises a projecting pin, and further comprising:

(d) a sidebar mechanism for restricting rotation of the cylinder, which is released by a proper alignment of the tumblers, (e) holes in one or both of said tumblers and sidebar and lugs in one or both of said sidebar and tumblers, so as to effect the release of the sidebar when movement of the tumblers places holes and lugs in proper alignment, (f) means for controlling both the linear sliding and rotational motions of the tumblers using pairs of transverse key interface displacements; and (g) means for restricting rotation of the cylinder, which restriction is released by proper alignment between holes and/or lugs on the tumblers and holes and lugs on the sidebar; and wherein a flat interface between tumblers and sidebar lugs, is provided by their configuration and alignment, so as to prevent changes in lock behavior as tumblers and lugs approach correct alignment that would reveal information about the correct alignment.

3. The lock of claim 2 with means for controlling both the sliding linear and rotational motion of the tumblers using pairs of purely transverse key interface displacements.

4. The lock of claim 2 comprising holes in one or more tumblers including a first hole centrally located in the tumbler that receives a sidebar projection pin and is situated in relation to spaced lugs of the tumbler which respond to key surface guiding contact, the tumbler body including one or more further through holes and/or lugs of the tumbler, the relation of the first hole to the further holes and/or lugs being effective to enable the guiding response movement to move such holes or lugs through a wide range of motion to align said one or more further holes of the tumbler with one or more lugs or holes of the sidebar sufficiently to release the sidebar whereby a high number of lock combinations is enabled for increased lock security.

5. The lock of claim 1 with means for controlling both the transverse and rotational motion of the tumblers using pairs of purely transverse key interface displacements.

6. The lock of claim 5 with means for restricting rotation of the cylinder, which is released by proper alignment between holes on the tumblers and lugs on the sidebar.

7. The lock of claim 6 with a flat interface between tumblers and sidebar lugs, so as to prevent changes in lock behavior as tumblers and lugs approach correct alignment.

8. The lock of claim 7 with sidebar lug cross-section effecting resistance to forcing.

9. The lock of claim 8 with a system of one or more inactive decoy holes in the tumblers, producing a change in behavior that mimics the effects of correct alignment between tumblers and lugs, but cannot be accurately distinguished from correct alignment until all tumblers are in either correct or decoy alignment relative to the sidebar.

10. The lock of claim 1 further comprising a flexible interface between the sidebar and housing, so as to deform under excessive force in such a way as to reduce force on the sidebar lugs and thereby prevent unlocking.

11. The lock of claim 1 in combination with a conventional key for sliding in the key way.

12. The lock of claim 1 further comprising a system of decoy holes in the tumblers, producing a change in unlocking behavior that mimics the effects of correct alignment between tumblers and lugs, but cannot be accurately distinguished from correct alignment until all tumblers are in either correct or decoy alignment.

13. The lock of claim 1 comprising holes in one or more tumblers including a first hole centrally located in the tumbler that receives a sidebar projection pin and is situated in relation to spaced lugs of the tumbler which respond to key surface guiding contact, the tumbler body including one or more further through holes and/or lugs of the tumbler, the relation of the first hole to the further holes and/or lugs being effective to enable the guiding response movement to move such holes or lugs through a wide range of motion to align said one or more further holes of the tumbler with one or more lugs or holes of the sidebar sufficiently to release the sidebar whereby a high number of lock combinations is enabled for increased lock security.

* * * * *